United States Patent [19]

Cahill

[11] Patent Number: 5,024,705

[45] Date of Patent: Jun. 18, 1991

[54] PAINT BRUSH CLEANING SYSTEM

[76] Inventor: Claire M. Cahill, 300 East Beach Road, Charlestown, R.I. 02813

[21] Appl. No.: 521,837

[22] Filed: May 10, 1990

[51] Int. Cl.[5] ..... A47L 25/00

[52] U.S. Cl. ..... 134/38; 15/1; 15/105; 134/6; 134/92; 134/143; 206/209; 206/229; 211/74

[58] Field of Search ..... 15/1, 105; 206/209, 206/229; 134/6, 38, 92, 143; 211/65, 71, 74

[56] References Cited

U.S. PATENT DOCUMENTS

| | | | |
|---|---|---|---|
| 64,271 | 4/1867 | Annin . | |
| 170,288 | 11/1875 | Miller . | |
| 1,110,533 | 9/1914 | Carmichael | 206/209 |
| 1,236,085 | 8/1917 | Hudnut . | |
| 2,643,661 | 6/1953 | Shanahan, Jr. . | |
| 2,646,808 | 7/1953 | Yenne | 206/209 X |
| 2,701,575 | 2/1955 | Friedman | 134/92 |
| 2,931,514 | 4/1960 | Hughes . | |
| 4,607,752 | 8/1986 | Sherrow . | |
| 4,974,763 | 12/1990 | Widrig | 15/105 |

*Primary Examiner*—Edward L. Roberts
*Attorney, Agent, or Firm*—Albert W. Hilburger

[57] ABSTRACT

A system is provided for cleaning paint brushes whose bristles have, from use, developed liquefied accumulations thereon of an oil base paint. A plurality of transparent vessels, each containing the same liquid solvent, are supported in a first predetermined serial relationship such that a paint brush with accumulations of paint thereon can be immersed in sequence in the solvent contained in each of the vessels. A towel dispenser provides toweling for wiping the paint brush to mechanically remove the accumulations of paint thereon before and after immersion of the paint brush into the solvent contained in each of the vessels. Covers are removably attached to each of the vessels for selectively sealing the solvent from the atmosphere. Indicia may be applied to the covers or otherwise associated with the vessels. When the liquid solvent in the first one of the vessels has become substantially contaminated with paint residue from brushes which have previously been cleaned, the remaining vessels are advanced with each successor vessel assuming the former position of a preceding vessel, and a vessel containing fresh solvent is placed in the position of the vessel which was formerly last such that the vessels thereby assume a second predetermined serial relationship.

15 Claims, 2 Drawing Sheets

PAINT BRUSH CLEANING SYSTEM

BACKGROUND OF THE INVENTION

I. Field Of The Invention

The present invention relates generally to paint brush cleaning systems and, more particularly, to an easily used, economical, system for effectively cleaning paint brushes used for applying oil base paints. The system should be employed immediately after the brush has been used.

II. Description Of The Prior Art

For many years oil base paints enjoyed success as a primary protective covering for a variety of surfaces. However, with the advent of new types of coverings, particularly, water based paints, such as latex paint, their usage has diminished to a great extent, even among professional painters.

Oil base paints are known for their durability and ability to protect an underlying surface for an extended period of time. They have a natural affinity for wood, seeping into the pores of the wood and forming a lasting bond. The protective nature of oil base paints, however, is not restricted to wood surfaces. Rather, they are commonly used on a variety of other surfaces including metal and plastics.

In contrast, water base paints, such as latex, do not bond as well to the substrate to which they are applied. Rather, they encapsulate the substrate and when the integrity of the paint is compromised, they tend to peel off from the underlying surface in large strips, leaving large areas of the underlying surface exposed to the elements.

Although oil base paints are often preferable from the standpoint of durability and protection, a primary difficulty in their use resides in the cleanup of the brushes and other appliances used in their application. Improper cleaning leads to loss of brushes and considerable expense as a result. A system which would facilitate the cleaning of brushes and assure the ease and thoroughness of the cleaning operation would help substantially to increase the usage of oil base paints once again. This is the intended goal of the present invention.

A number of patents can be cited as being typical of known instrumentalities used generally in cleanup operations. For example, U.S. Pat. No. 64,271 to Annin and U.S. Pat. No. 2,643,661 to Shanahan, Jr., disclose the systematic cleaning of jewelry using a plurality of different liquids into which the jewelry is sequentially immersed.

In another instance, U.S. Pat. No. 4,607,752 to Sherrow discloses a paint brush cleaning rack for suspending soiled paint brushes in disposable cups containing cleaning fluids. According to the patent, the number and location of brushes and cups may be varied so that brushes of different sizes and containing different colors of paint and different paint bases can be cleaned simultaneously in different solvents.

Stands or trays of the type disclosed in U.S. Pat. No. 1,236,085 to Hudnut have also been known. These are of the type which support a plurality of aligned bottles for unspecified purposes but such as to permit ready removal or replacement of the bottle.

Also known are towel rollers or racks of the type disclosed in U.S. Patent No. 170,288 to Miller or U.S. Pat. No. 2,931,514 to Hughes associated with some manner of receptacle.

SUMMARY OF THE INVENTION

It was with knowledge of the foregoing state of the technology that the present invention was conceived and has now been reduced to practice. The invention relates to a system for cleaning paint brushes whose bristles have, from use, developed liquefied accumulations thereon of an oil base paint. For this purpose, a plurality of transparent vessels, each containing the same liquid solvent, are provided. They are supported in a first predetermined serial relationship such that a paint brush with accumulations of paint thereon can be immersed in sequence in each of the vessels containing solvent. A towel dispenser provides toweling for wiping the paint brush during the process to mechanically remove the accumulations of paint thereon. The brush is wiped initially and then after immersion of the paint brush into the solvent contained in each of the vessels. Covers are removably attached to each of the vessels for selectively sealing the solvent from the atmosphere. Indicia, which may be numerical symbols, alphabetical symbols, or alphanumeric symbols, may be applied to the covers or otherwise associated with the vessels. When the liquid solvent in the first one of the vessels has become excessively contaminated with paint residue from brushes which have previously been cleaned, the solvent in the first vessel is discarded. Then, the remaining vessels are advanced with each successor vessel assuming the former position of a preceding vessel. A vessel containing fresh solvent is then placed in the position of the vessel which was formerly last such that the vessels thereby collectively assume a second predetermined serial relationship. A brush can thereby be cleaned efficiently and rapidly with minimal waste of solvent.

The novel system of the invention has numerous features and benefits. As previously mentioned, it promotes the use of oil base paints which generally provide a preferred coating for a substrate to be protected.

Additionally, the system of the invention is economical in that the solvent used for cleaning the brushes can be used over and over again rather than being discarded after a single use. The invention also provides for the storage of the solvent for long periods of time without reducing the effectiveness of the solvent. A further benefit naturally follows from the economical characteristic of the invention, namely, that it is environmentally desirable. Specifically, the solvent used in the cleaning the brushes is used for a much longer period of time and is only discarded when it can no longer serve its intended function.

Other benefits of the invention reside in its compactness, and convenience, capable of being readily mounted in a proper and desirable work area. When so mounted, the system, which is essentially self-contained, remains substantially out of the way while being available whenever needed. In the alternative, it can be readily dismounted and stored for use at a future time.

Further, the system of the invention uses readily available components and can be used by professional and amateur alike.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate different embodiments of the invention, and, together with the description, serve to explain the principles of the invention in general terms. Like numerals refer to like parts throughout the disclosure.

DETAILED DESCRIPTION OF THE PREFERRED EMBODIMENTS

Figure 1:
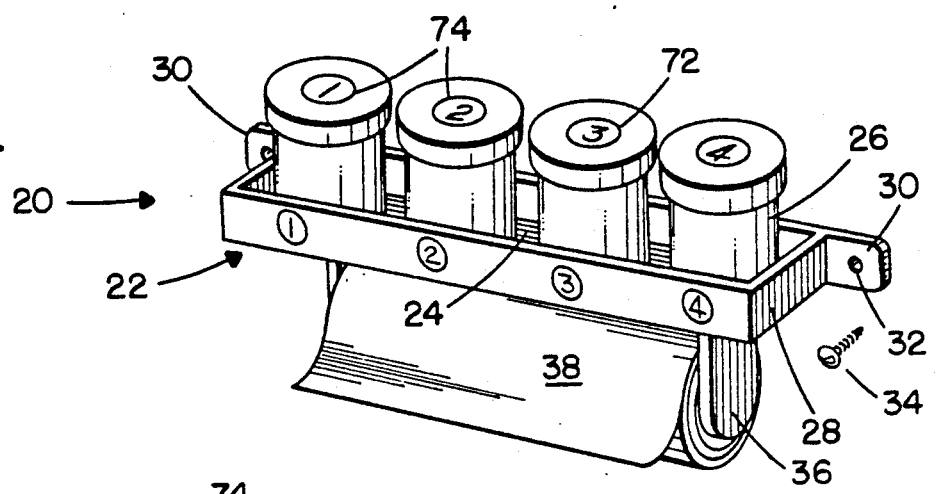
FIG. 1 is a perspective view generally illustrating a paint brush cleaning system embodying the invention.

Turn now to the drawings, and initially to FIG. 1, which generally illustrates a paint brush cleaning system 20 which embodies the present invention. The system 20 includes a tray 22 or other suitable support element including a base 24 on which a plurality of vessels 26 can be supported and associated sidewalls 28 to prevent the vessels from inadvertently moving off the base 24. The vessels 26 are lined up in a row such that they assume a serial relationship as denoted by the sequential numerals "1", "2", "3", and "4", suitably provided on a foremost one of the sidewalls 28.

Figure 1A:
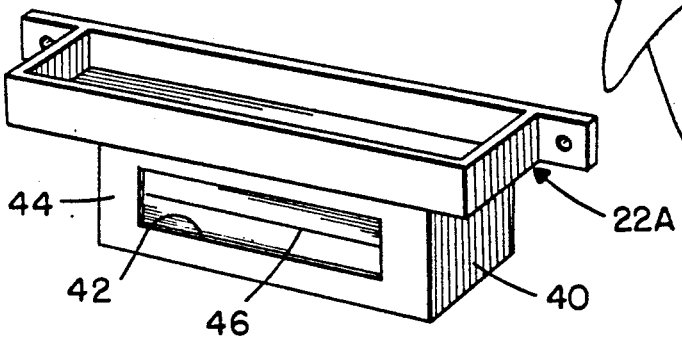
FIG. 1A is a detail perspective view illustrating a modified component of the paint brush cleaning system.

The tray 22 may also be provided with a pair of opposed mounting flanges 30, each formed with a through bore 32 adapted to receive a suitable fastener 34 for mounting to a wall or other appropriate supporting structure. Additionally, a pair of spaced apart, downwardly depending mounting ears 36 may be fastened to, or integral with, an underside of the base 24 to suitably support a roll 38 of paper toweling. It will be understood, however, that other styles of dispensers for paper toweling or even for toweling made of cloth or of other materials could be provided in association with the tray 22. For example, as seen in FIG. 1A, a modified tray 22A has a dispenser 40 mounted to it or is integral with the tray. A suitable opening 42 is provided in a front wall 44 of the tray 22A to allow for the dispensing of towels 46 which may be cloth, paper, or of other suitable absorbent, preferably sheet, material.

Figure 2:
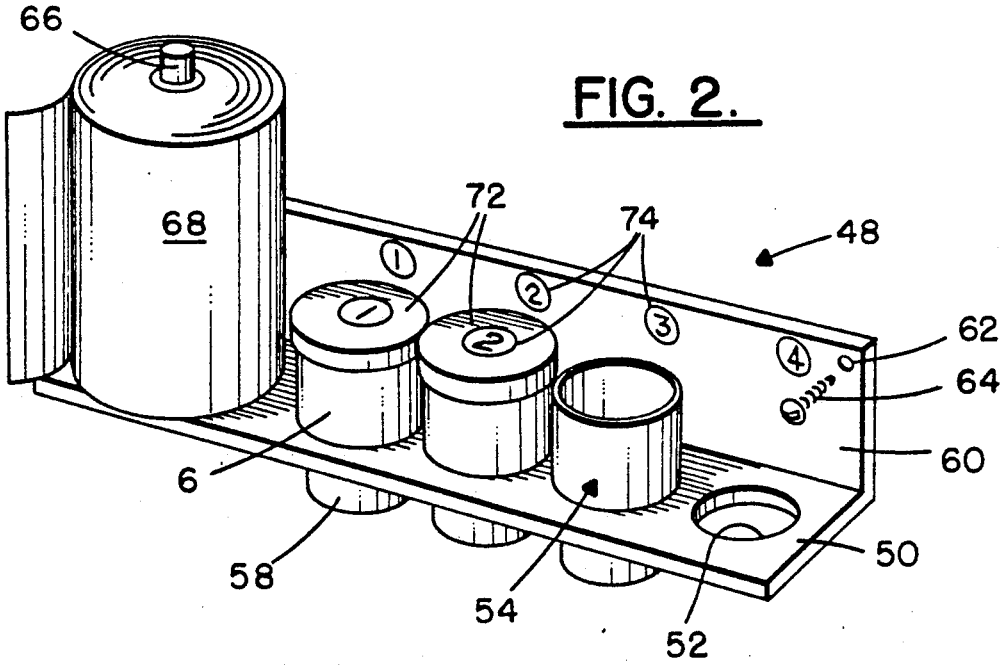
FIG. 2 is a perspective view of a modified cleaning brush cleaning system embodying the invention.

In FIG. 2, a paint brush cleaning system 48 is illustrated which is of a different construction from the cleaning system 20, although in general terms it is functionally the same. In this instance, an elongated support plate 50 has a series of aligned, spaced, apertures 52 for supportively receiving a plurality of appropriately shaped vessels 54. Each vessel 54 has an upper component 56 which has breadth greater than that of the aperture 52 and a lower component 58 which has a smaller breadth than that of the aperture so as to be freely receivable through the aperture. Thus, each vessel 54 can be removably placed on the support plate 50 such that an underside of the upper component 56 rests on an upper surface of the support plate, with the lower component 58 extending downwardly through the aperture.

Integral with the support plate 50 is a mounting plate 60 which lies in a plane generally transverse of that of the support plate. The mounting plate is provided with at least a pair of through bores 62 (only one being shown) for freely receiving a suitable fastener 64 enabling the mounting of the cleaning system 48 to a wall or other suitable support structure. The support plate 50 and mounting plate 60 may be of any suitable materials such as metal, wood, or plastic and may be formed in any suitable manner depending upon the material chosen.

An upstanding post 66 is provided at one end of the support plate 50 and serves to rotateably guide a roll 68 of paper toweling or other suitable wiping material which is upended and supported on the support plate 50.

Figure 3A:
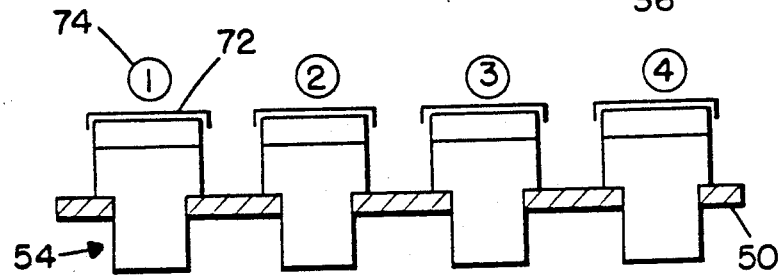
FIGS. 3A, 3B, 3C, and 3D are diagrammatic front elevation views illustrating a part of the system illustrated in FIG. 2 and depicting, respectively, sequential steps in the process for which the system of the invention is intended.

As illustrated in FIG. 3A, prior to initiating the process of the invention, which is about to be described, each of the vessels 54 (or vessels 26 in the instance of the FIG. 1 embodiment) is filled to a moderate level with a suitable paint solvent 70 such as turpentine or paint thinner. While each vessel 54 is preferably transparent in order to more readily discern the quality of the solvent 70 therein, such should not generally be a limiting requirement of the invention. Each vessel 54 is provided with a removable cover 72.

The cover 72 serves to seal the contents of its associated vessel when in place but can be readily removed to enable a user of the system to gain access to the solvent 70. With the components of the paint brush cleaning system now fully described, its operation will be explained with reference to cleaning system 48 illustrated in FIG. 2. However, it is to be understood that whatever is stated with respect to the cleaning system 48 applies in a similar fashion to the cleaning system 20 of FIG. 1.

At the outset of the operation of the invention, the vessels 54, each containing the same solvent 70, are positioned on the support plate 50 and freely engaged with their respective apertures 52. As a result, the four vessels 54 thereby assume an initial predetermined serial relationship. This relationship may be denoted by suitable indicia 74 such as the previously mentioned numerals "1", "2", "3", and "4" which may be provided on the mounting plate 60 adjacent each respective vessel 54. Of course, any other numbering or lettering system may be used. For example, the indicia 74 may be provided on the covers 72 or, indeed, the indicia may merely be the relative positioning of the vessels 54 on the support plate 50 without the use of numerals, letters, or the like. For purposes of this explanation, the terms first station, second station, third station, and fourth station will be indicated, respectively, by the numerals "1", "2", "3", and "4".

Figure 4:
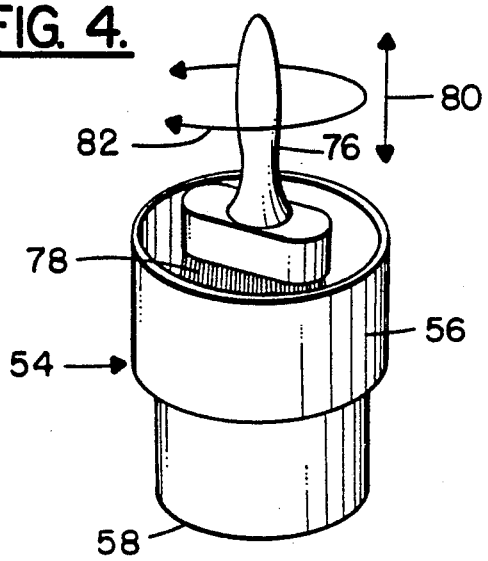
FIG. 4 is a detail perspective view illustrating one step in the process depicted in FIGS. 3A–3D.

Turn now to FIG. 4. When it comes time to clean a paint brush 76 whose bristles 78 have accumulations of undried paint thereon, it is first wiped clean. Then it is inserted, bristles first, into the vessel 54 at the first station and immersed into the solvent 70 therein. The paint brush is vigorously agitated. That is to say, the brush is rapidly moved up and down in the direction of opposed arrowheads 80 and also in a circular motion as indicated by opposed arrowheads 82. This procedure serves to physically remove from the bristles of the brush a maximum amount of the paint which has become accumulated on the bristles. In this step of the process, it may even be desirable to tamp the tip ends of the bristles 78 on a bottom of the vessel 54.

Figure 5:
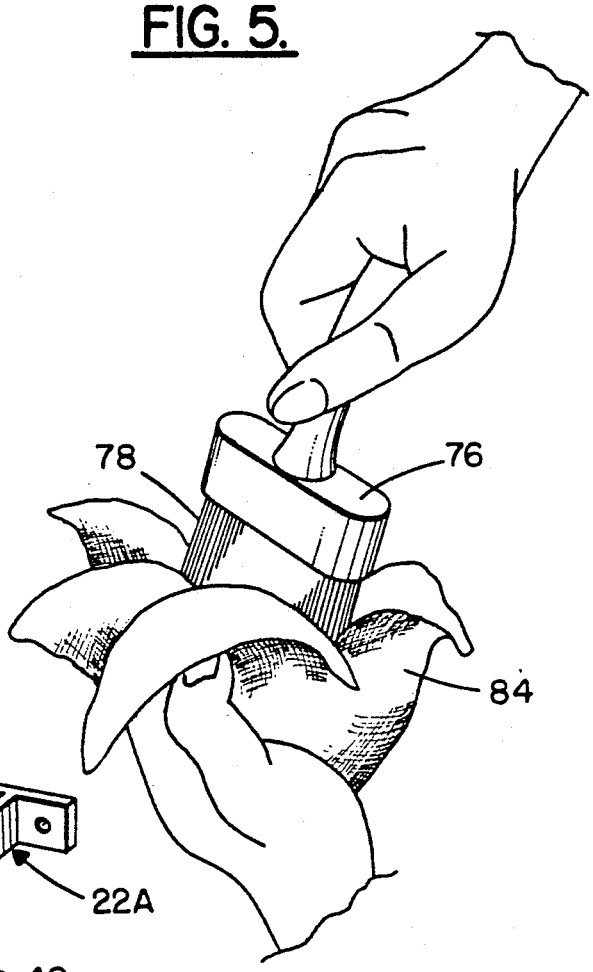
FIG. 5 is a detail perspective view illustrating another step in the process depicted in FIGS. 3A–3D.

After passage of a suitable period of time during which the paint brush is vigorously and thoroughly agitated at the first station, it is removed from the vessel 54. Thereupon, a sheet of toweling is removed from the roll 68 and the paint brush is wiped thoroughly as seen in FIG. 5 so as to mechanically remove from the bristles a maximum amount of the paint accumulations which still remain on it. This procedure is repeated at each of the succeeding second, third, and fourth stations after which the brush 76, with cleaned bristles 78 is once again in condition for use. It can then be wrapped in plastic or in metallic foil for storage or maintained in some other suitable manner if it is not to be used again in the near future.

It will be appreciated that, at the outset of the process just described, it would be desirable to squeeze the bristles 78 on the rim of the paint container to return as much of the paint as possible to the container. Thereafter, it would also be desirable to mechanically remove as much of the excess paint that remains by means of a sheet of toweling 84 in the manner illustrated in FIG. 5 before even beginning the process at the first station.

Figure 3B:
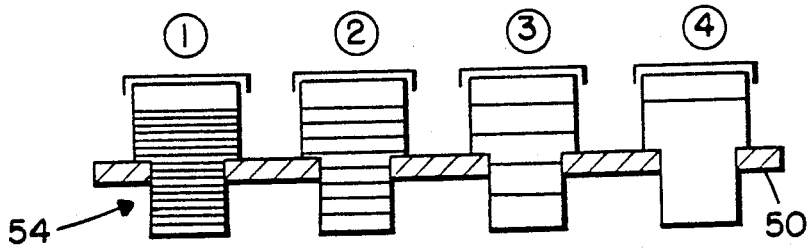
Figure 3C:
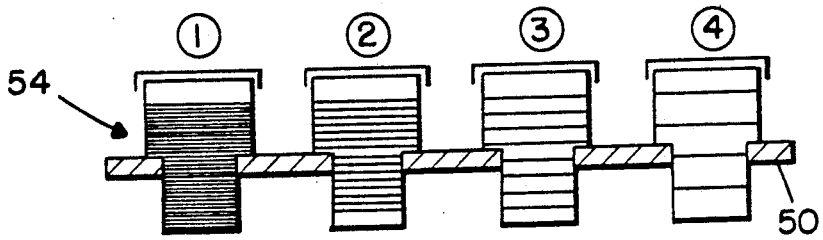

With continued usage of the cleaning system, the solvent 70 within the vessels 54 becomes more and more clouded or contaminated with the paint removed from the brushes being cleaned. Indeed, as seen particularly well in FIGS. 3B and 3C, the vessel 54 at the first station becomes more clouded or contaminated at a faster rate than do the vessels at the second, third, and fourth stations. This is, of course, because a majority of the paint accumulated on the paint bristles 78 is removed at the first station as each brush is cleaned.

Figure 3D:
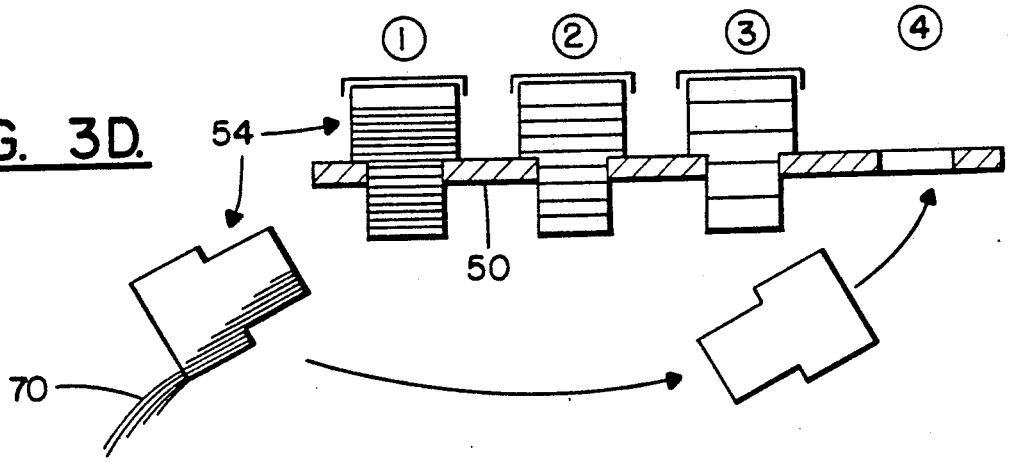

Finally, there comes a time when the solvent at the first station becomes so clouded or contaminated that it no longer properly performs its intended function. It is then desirable to remove it from the system, as indicated in FIG. 3D. The contaminated solvent 70 is then discharged from the vessel in an environmentally safe manner. After removal of the vessel from the first station, the vessel at the second station is then moved to the first station and each of the succeeding vessels is similarly advanced. The vessel originally at the first station and from which the contaminated solvent has been discharged may then be cleaned, filled with fresh solvent, and returned to the support plate 50. Alternatively, a new vessel may be placed on the support plate to take the place of the vessel which had earlier been at the fourth station and appropriately advanced. The vessel 54 newly placed at the fourth station is then filled to a proper level with fresh solvent 70. When the vessels have attained their new positions, the covers 72 with indicia 74 thereon would be changed to reflect the revised, or "new", relative positioning of the vessels.

In this manner, a paint brush 76 can be effectively cleaned within a very short period of time and the amount of solvent necessary to achieve this exceptional cleaning result is minimized.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A process for cleaning paint brushes whose bristles have, from use, developed liquefied accumulations thereon of an oil base paint, said process comprising the steps of:

providing a plurality of vessels, each containing the same liquid solvent of a type capable of physically loosening and removing from a paint brush the accumulations of paint which have developed thereon;

assembling the vessels into a first predetermined serial relationship;

inserting a paint brush which has accumulations of paint thereon into a first one of the vessels;

vigorously agitating the paint brush in the first one of the vessels so as to physically remove from the brush a maximum amount of the paint accumulations;

removing the paint brush from the first one of the vessels;

wiping the paint brush with an absorbent towel so as to mechanically remove from the bristles of the brush a maximized amount of the paint accumulations;

repeating the preceding two steps in sequence at least one additional time;

thereby providing a brush with cleaned bristles, suitable for use once again.

2. A process for cleaning paint brushes as set forth in claim 1 including the steps of:

removing from the predetermined serial relationship the first one of the vessels when the liquid solvent therein has become substantially contaminated with solute in the form of paint residue from paint brushes which have previously been cleaned therein;

advancing the remaining vessels such that each successor one of the vessels assumes the former position of a preceding one of the vessels; and placing a vessel containing fresh solvent in the former position of a last one of the vessels whereby the plurality of vessels assume a second predetermined serial relationship.

3. A process for cleaning paint brushes as set forth in claim 2:

wherein the first recited step in claim 2 includes the steps of:

discarding the contaminated liquid solvent from the removed vessel;

after the preceding step, cleaning the removed vessel; and refilling the removed vessel with fresh solvent so that it is ready to assume the position of a last one of the vessels.

4. A process for cleaning paint brushes as set forth in claim 1 including the step of:

sealing the contents of each vessel from the atmosphere when not in use.

5. A process for cleaning paint brushes as set forth in claim 1 including the step of:

providing indicia for each vessel to indicate the first predetermined serial relationship among the plurality of vessels.

6. A process for cleaning paint brushes as set forth in claim 5 including the steps of:

removing from each of the vessels, as a consequence of the steps recited in claim 2, the indicia to indicate the first predetermined serial relationship; and after the preceding step, providing indicia for each vessel to indicate the second predetermined serial relationship among the plurality of vessels.

7. A process for cleaning paint brushes as set forth in claim 1 including the step of:

prior to inserting a paint brush which has accumulations of paint thereon into a first one of the vessels, wiping the paint brush with an absorbent towel so as to mechanically remove from the bristles of the brush a maximized amount of the paint accumulations thereon.

8. A process for cleaning paint brushes as set forth in claim 1 wherein the indicia are symbols selected from the group consisting of numerical symbols, alphabetical symbols, and alphanumeric symbols.

9. A system for cleaning paint brushes whose bristles have, from use, developed liquefied accumulations thereon of an oil base paint, said system comprising:

a plurality of vessels, each containing the same liquid solvent of a type capable of physically loosening and removing from a paint brush the accumulations of paint which have developed thereon, each adapted to receive a paint brush for immersion in the solvent contained therein;

support means for supporting said plurality of vessels in a first predetermined serial relationship;

indicia means associated with each of said vessels for indicating the first predetermined serial relationship enabling a paint brush with accumulations of paint thereon to be immersed in sequence in the solvent contained in each of said plurality of vessels; and towel dispensing means mounted on said support means for providing toweling for wiping the paint brush to mechanically remove accumulations of paint thereon following immersion of the paint brush in the solvent contained in each of said plurality of vessels.

10. A system for cleaning paint brushes as set forth in claim 9 wherein each of said vessels is composed of transparent material.

11. A system for cleaning paint brushes as set forth in claim 9 including:

cover means removably attached to each of said vessels for selectively sealing the contents thereof from the atmosphere.

12. A system for cleaning paint brushes as set forth claim 11 wherein said indicia means is provided on said cover means for indicating the first predetermined serial relationship.

13. A system for cleaning paint brushes as set forth in claim 11 wherein said plurality of vessels includes first, second, and third vessels occupying first, second and third positions, respectively, on said support means;

wherein said cover means includes a first cover initially associated with said first vessel, a second cover initially associated with said second vessel, and a third cover initially associated with said third vessel; and wherein said indicia means includes a first indicator on said first cover, a second indicator on said second cover, and a third indicator on said third cover;

said indicia means collectively indicating a second predetermined serial relationship which occurs when said first vessel is removed from said first position on said support means because the liquid solvent in said first vessel has become substantially contaminated with solute in the form of paint residue from paint brushes which have previously been cleaned therein, and said second and third remaining vessels are advanced to said first and second positions, respectively, and a replacement vessel containing fresh liquid solvent is placed in said third position on said support means whereby the plurality of said vessels assume a second predetermined serial relationship, said first cover hereafter being associated with said second vessel occupying said first position on said support means, said second cover hereafter being associated with said third vessel occupying said second position on said support means, and said third cover hereafter being associated with said new vessel occupying said third position on said support means.

14. A system for cleaning paint brushes as set forth in claim 9 wherein said indicia are symbols selected from the group consisting of numerical symbols, alphabetical symbols, and alphanumeric symbols.

15. A system for cleaning paint brushes as set forth in claim 9 wherein said support means includes an elongated support member having an upper surface and a plurality of aligned, spaced, openings therein; and wherein each of said vessels includes:

an upper compartment having a breadth greater than the openings in said support member;

a lower compartment smaller than the openings in said support member and freely extendible therethrough; and an undersurface between said upper compartment and said lower compartment;

whereby, when said plurality of vessels is placed on said support member with said lower compartment of each said vessel extending through an associated opening in said support member and said undersurface of each said vessel rests on said upper surface of said support member, said plurality of vessels assumes the first predetermined serial relationship.

* * * * *